US005813247A

United States Patent [19]

Strobl

[11] Patent Number: 5,813,247

[45] Date of Patent: Sep. 29, 1998

[54] APPARATUS CABINET FOR PROVIDING OF PROCESS

[75] Inventor: Klaus Strobl, Inchenhofen, Germany

[73] Assignee: Baldwin-Gegeheimer GmbH, Augsburg, Germany

[21] Appl. No.: 968,874

[22] Filed: Nov. 5, 1997

Related U.S. Application Data

[63] Continuation of Ser. No. 546,491, Oct. 20, 1995, abandoned.

[30] Foreign Application Priority Data

Nov. 11, 1994 [DE] Germany ..... 44 40 380.1

[51] Int. Cl.[6] ..... F25D 17/02

[52] U.S. Cl. ..... 62/434; 62/259.1; 101/487

[58] Field of Search ..... 62/430, 434, 435, 62/389, 393, 259.1; 101/487, 488

[56] References Cited

U.S. PATENT DOCUMENTS

| | | | |
|---|---|---|---|
| 4,854,726 | 8/1989 | Lesley et al. . | |
| 5,097,669 | 3/1992 | Hargrove | 62/434 |
| 5,197,537 | 3/1993 | Chigira et al. | 62/434 |

FOREIGN PATENT DOCUMENTS

| | | |
|---|---|---|
| 0170160 | 7/1985 | European Pat. Off. . |
| 7517192 | 11/1975 | Germany . |
| 2745741 | 10/1977 | Germany . |
| 4202544 | 8/1983 | Germany . |
| 3228124 | 11/1983 | Germany . |
| 3727298 | 3/1989 | Germany . |
| 3818321 | 12/1989 | Germany . |
| 9101888 | 5/1991 | Germany . |
| 9316932 | 11/1993 | Germany . |
| 4307732 | 7/1994 | Germany . |
| 9309951 | 5/1993 | WIPO . |

OTHER PUBLICATIONS

Der Trockenoffsetdruck mit MAN–Druckmaschinen, Druckwelt Oct. 1925, May 1993; pp. 37–38;.

Grapho Metronic Farbwerktemperierung, Grapho Metronic Mess and Regeltechnik GmbH & Co., Munich, No. 04/02–01/0582;.

Patent Abstracts of Japan, JP 53–5944(A); M–707, Jun. 10, 1988, vol.12, No. 201;.

*Primary Examiner*—John M. Sollecito

*Attorney, Agent, or Firm*—Ostrolenk, Faber, Gerb & Soffen, LLP

[57] ABSTRACT

An apparatus cabinet for providing process water, particularly for printing presses, having a housing with a top, intermediate and bottom level. A water conditioning device at the intermediate cabinet level a water-temperature control device having a coolant compressor arranged at the bottom level, a coolant condenser arranged at the top level, and a cooling blower device at the top level for conveying cooling air over the coolant condenser and out of the apparatus cabinet.

20 Claims, 1 Drawing Sheet

APPARATUS CABINET FOR PROVIDING OF PROCESS

This is a continuation of application Ser. No. 08/546,491 filed on Oct. 20, 1995, now abandoned.

BACKGROUND OF THE INVENTION

The present invention relates to an apparatus cabinet for providing process water, particularly for printing presses.

Federal Republic of Germany Utility Model G 91 01 888.9 U1 discloses a housing for providing damping solution for printing presses. The housing is divided into a lower and an upper region. A device for preparing damping solution is arranged in the lower region, while the upper region contains a cooling unit and a device for creating a substantially upwardly directed discharge flow of cooling air from the housing. The preparation device arranged in the lower region of the housing contains a conditioning container for the damping solution, a submersible pump submerged in the solution container, an alcohol constant holder for maintaining the alcohol content of the damping solution constant, fresh-water connecting means for feeding fresh water into the conditioning container, and an automatic metering device for metered feeding of a damping-agent concentrate to the fresh water. The cooling unit arranged in the upper region of the housing contains a coolant condenser, a blower for producing a stream of cooling air along the cooling unit including its condenser, and a heat exchanger for the heat exchange between the coolant and the prepared damping solution. The cooling air is drawn by the blower through a grid in the front side of the housing into the upper region of the housing and is blown upward out of the housing through one or more outlet openings provided on the top side of the housing. The housing has supporting legs or travel rollers.

In damping during offset printing, the surface of a plate cylinder is damped with "damping solution" at the places which are to repel the ink, while regions lying alongside the damped regions accept printing ink in accordance with the printed image desired. The damping solution consists essentially of fresh water, some amount of alcohol, and some "additive" which imparts properties desired for the printing process to the water. The damping solution passes through a feed line to the corresponding printing press. Part of the solution is applied to the plate cylinder and the excess is returned via a return line to the conditioning container. The damping solution can also be applied in the printing press to other cylinders or rollers or to the material to be printed in order to give them certain properties. The preparation of damping solution and its use in printing presses is described further in Federal Republic of Germany Unexamined Application 42 02 544 A1. Although that document discloses damping solution to be applied only to a plate cylinder, it has been found, as mentioned above, that damping solution can also be used for wetting other elements in a printing press and, in particular, for also wetting of a blanket cylinder or an impression cylinder.

SUMMARY OF THE INVENTION

It is an object of the present invention to provide an apparatus cabinet for providing process water, and in particular damping solution or other liquid, for printing presses wherein the supply of liquid is easier and more dependable in use.

Another object of the invention is to position the various components for providing process water in an apparatus cabinet so as to make the cabinet stable and adequately support all of the components, yet provide good control over flow of the process water in the circuit within the container.

This object is achieved according to the invention, which most broadly concerns an apparatus cabinet for providing process water, particularly for use in printing presses, having a housing with a top, an intermediate and a bottom level. A water conditioning device is disposed in the intermediate cabinet level. A water-temperature control device having a coolant compressor is arranged in the bottom level. A coolant condenser is arranged in the top level, and a cooling blower device is disposed in the top level for conveying cooling air over the coolant condenser and out of the apparatus cabinet.

The apparatus cabinet with its three levels includes the water conditioning device which contains a water conditioning container in which the processing water is conditioned with respect to both its content components and its temperature. The water conditioning device is primarily located in the intermediate level of the apparatus cabinet at an operating height generally between the knee and chest height of an average height operator standing up.

A water temperature control device controls the temperature of the process water, and that device includes a coolant circuit separate from the process water. In the direction of coolant flow, the coolant circuit includes a coolant compressor for compressing the coolant, a coolant condenser, preferably air cooled, and means, preferably air flow, for cooling the coolant. The condenser and the means for cooling the air in the cooler condenser are in the upper level of the apparatus cabinet. Beyond the coolant condenser, there are means for collecting the coolant, particularly possibly a coolant collector. A coolant expansion valve follows the means for collecting the coolant, and the expansion causes cooling of the coolant. There is a heat exchanger through which the coolant passes and the heat exchanger cools the process water, either by the process water passing close by it or over it or by a process water circuit passing by the heat exchanger and delivering the cooled water to the conditioning container. The coolant compressor and coolant collector are in the bottom level of the housing.

There is an airflow entrance and exit at the top level of the housing for the coolant air passing over the coolant condenser. The positions of various elements within the housing include the expansion valve being at the housing bottom level, the heat exchanger being at the bottom level, containers for additional components to be provided to the process water being at the bottom level, a possible circuit for external processing of the process water being at the bottom level and being connected with the conditioning container and a fresh water connection to the conditioning container being at the lower level. A metering device, connected with an electronic control device in the door of the housing operates and meters the addition of additional components to the process water. The housing may be comprised of two housings, a bottom housing enclosing the intermediate and bottom levels and an upper housing enclosing the top level with a cabinet door extending over both levels.

Other features and advantages of the present invention will become apparent from the following description of the invention which refers to the accompanying drawings.

DETAILED DESCRIPTION OF THE INVENTION

Figure 1:
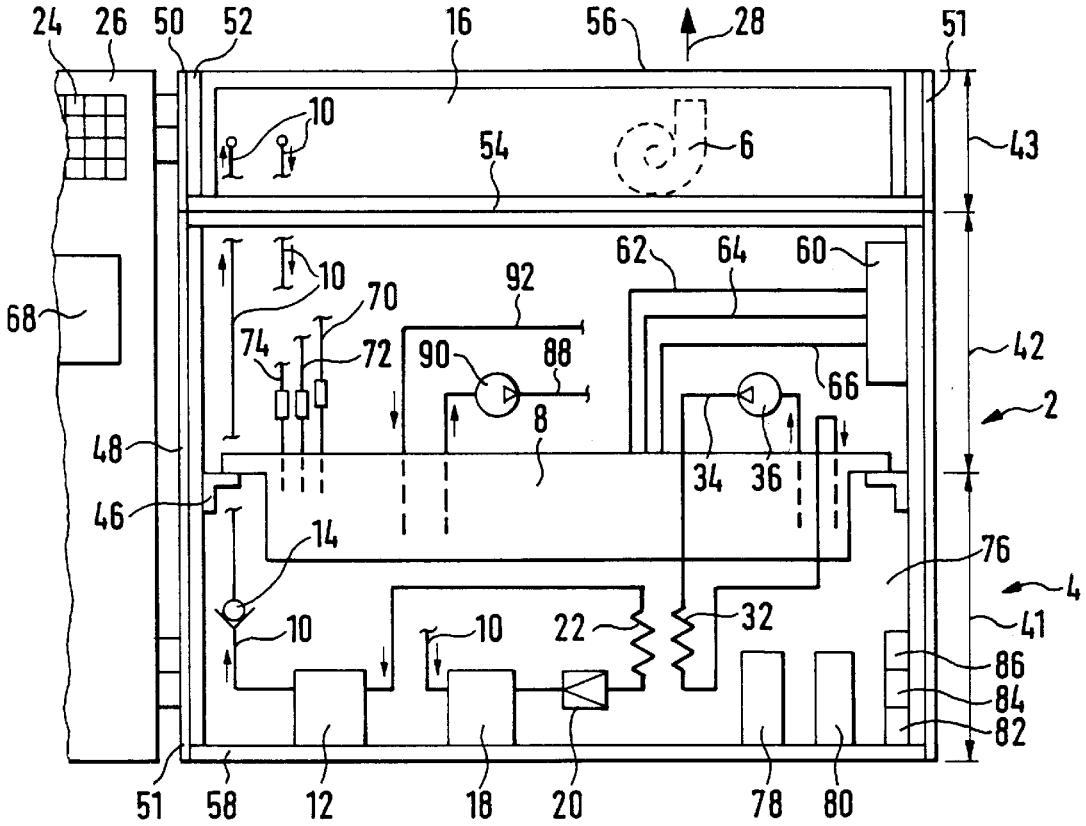
FIG. 1 schematically shows an apparatus cabinet in accordance with the invention with the cabinet door open.
Figure 2:
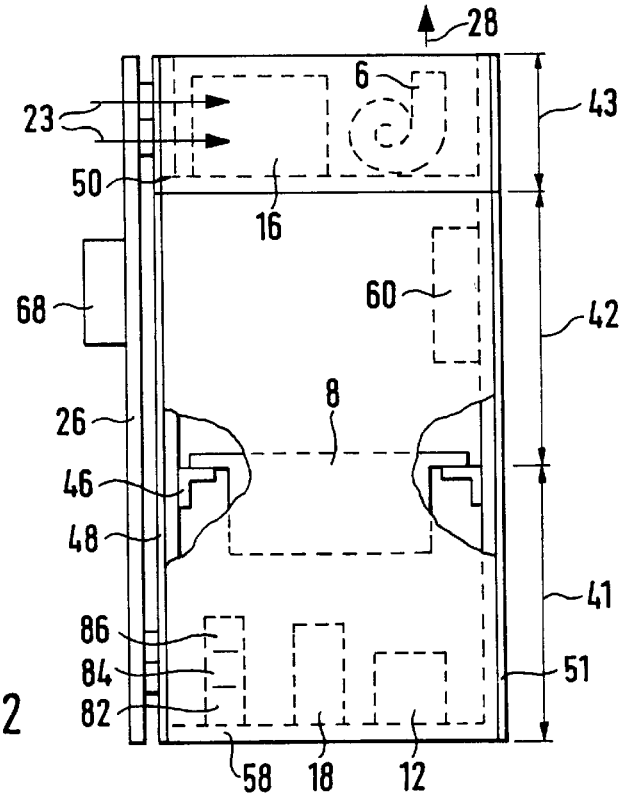
FIG. 2 is a right-side view of the apparatus cabinet of FIG. 1.

The following description assumes that the apparatus cabinet for providing process water provides damping solution for an offset printing press. Other uses may be apparent to persons of skill in the art.

The apparatus cabinet contains a water conditioning device 2, a water temperature control device 4, and a cooling-air blower device 6.

The process water conditioning device 2 contains at least one conditioning container 8 in which the process water is conditioned with respect to its components and its temperature, primarily so that the water level and the percentage of components in the solution may be maintained constant.

The water temperature control device 4 controls the temperature of the process water. It contains at least one coolant circuit 10 which is separate from the process water and acts to cool the process water. The coolant circuit includes, in the direction of flow of the coolant indicated by the flow arrow, a compressor 12, a non-return valve 14, a coolant condenser 16, a coolant collector 18, a coolant expansion valve 20, a heat-exchanger element 22, and then, again, the compressor 12. The compressor 12 compresses coolant and changes it from a gaseous to a liquid state. The non-return valve 14 prevents return flow of coolant from the coolant condenser 16 into the compressor 12. Coolant condenses in the coolant condenser 16. The heat which is thereby liberated is discharged to outside of the apparatus cabinet by the cooling-air blower device 6.

The cooling-air blower device 6 draws air 23 from the outside atmosphere through a vent opening 24 in a front cabinet door 26 into the apparatus cabinet and, inside the cabinet, over the coolant condenser 16, or through passage openings formed in it. Then the heated air flows through the cooling-air blower device 6 and is expelled upwardly from it out of the apparatus cabinet, as shown by the arrow 28. For this purpose, the apparatus cabinet can be open on top or be provided with one or more vent openings.

Condensed coolant can collect in the coolant collector 18. If the lines of the coolant circuit are of a suitably large cross section, they can serve as a collector and the collector 18 can be dispensed with. The compressed coolant can expand in the expansion valve 20 which is arranged upstream of the heat exchanger element 22. This produces cold, which is transmitted by the heat exchanger element 22 arranged directly downstream of the expansion valve 20 in the direction of flow via another heat exchanger element 32 to the process water. The two heat exchanger elements 22 and 32 together form a heat exchanger.

The second heat exchanger element 32 is traversed by the process water. It is located in a process-water temperature-control circuit 34 downstream of a temperature-control circulation pump 36. The temperature-control circulation pump 36 conducts process water, in the present case damping solution, out of the conditioning container 8 and through the heat-exchanger element 32, and then back into the conditioning container 8. In another embodiment (not shown), the one heat-exchanger element 22, through which the coolant passes, is immersed in the process water in the conditioning container 8 and is thus in direct contact with the process water, so that the second heat-exchanger element 32 is then not required.

In order for the cooling-water expansion valve 20 to have good efficiency, it must be arranged as close as possible upstream to the first heat-exchanger element 22 which is passed through by coolant. Therefore, in the further embodiment mentioned above, it can be arranged either in the bottom of the apparatus cabinet as in FIG. 1 or in the center of the apparatus cabinet, close to the conditioning container 8.

The apparatus cabinet includes two housings and is divided into three levels 41, 42, and 43, arranged one above the other. The lowermost or bottom level 41 is separated from the intermediate or middle level 42 by the conditioning container 8 which is contained in the middle level 42 and the container 8 is suspended in removable manner in a housing frame 46 of a lower housing 48. The lower level 41 and the middle level 42 are formed in the lower housing 48. The top level 43 is formed in an upper housing 50 and its housing frame 52 which sits in removable or detachable manner on the lower housing 48. The outer walls of the two housings 48 and 50 are aligned with each other. The front sides of the two housings 40 and 50 can be closed by the housing door 26, which is common to them and extends over the height of both housings. The side walls of the two housings 48 and 50 are formed by sheet-metal plates 51 on the housing frames 46 and 52. The bottom 40 of the level between the middle level 42 and the top level 43 can be open or closed. If it is in closed condition, passage openings are present for the passage of fluid lines of the coolant circuit 10 and electric lines.

The apparatus cabinet as a whole, however, is developed so that the air 23 drawn in from the outer atmosphere by the cooling-air blower device 6 in the top level 43 is drawn through the vent opening 24 formed in the top level 43 in the cabinet door 26 substantially horizontally into the top level 43 and flows there over or through the condenser 16 before it is expelled via the cooling-air blower device 6 substantially vertically upward, as indicated by the arrow 28 in FIG. 1, from the top level 43 through a roof opening 56 and back into the atmosphere. As shown in FIG. 1, the coolant-air blower device 6 and the coolant condenser 16 of the water-temperature control device 4 are located in the top level 43. At least the coolant compressor 12 and the coolant collector 18 of the water-temperature control device 4 are present in the bottom level 41. In the preferred embodiment shown in FIG. 1, the coolant expansion valve 20 and two heat exchange elements 22 and 32 as well as the return valve 14 present downstream of the compressor 14 are arranged in the bottom level.

The heavy parts, such as the compressor 12 and the collector 18, are located in the bottom level 41. In this way, the apparatus cabinet has a low center of gravity and thus has good stability. The apparatus cabinet can thus be made relatively light in weight, since it does not need the stability required for supporting heavy parts. The apparatus cabinet preferably does not have any legs, so that the cabinet bottom 58 of the bottom level 41 lies directly on the floor. When the conditioning container 8 contains process water, it is also heavy. But, it is still at such a low height that the housing frame 46 of the lower housing 48 need be correspondingly stable and heavy only up to this low height. It is also a great advantage that the conditioning container 8 lies at a height which makes it convenient for an operator to inspect the inside of the container, remove the conditioning container 8 if necessary and reinsert it, and check the electrical, hydraulic or pneumatic devices necessary for the conditioning of the process water as well as the measuring instruments and service them, as well as to mount or replace them. For this purpose, the conditioning container 8 is preferably arranged between knee height and chest height of an operator of average height.

A metering device 60 is fastened to the cabinet wall in the middle level 42. It feeds, for instance, fresh water via a fresh-water line 62, additives via an additive line 64, and alcohol via an alcohol line 66 into the conditioning container 8 as a function of an electronic control device 68 which is fastened in the middle level 42 on the inside of the cabinet door 26. The feeding or metering of fresh water, additives, and alcohol is governed by sensors which constantly measure the level of the water, the content of additives in it, and the content of alcohol within the conditioning container 8 and which report this to the electronic control device 68 and/or to the metering device 60. For this, FIG. 1 diagrammatically shows a liquid level sensor 70, an alcohol sensor 72, and a sensor 74 for additives. The metering device 60 contains metering means and valves.

Because hot air rises, the positioning of the coolant condenser 16 in the top level 43, makes only a short path for the cooling air 54, 16 necessary within the apparatus cabinet. The positionings of the coolant condenser 16 in the top level 43 and of the conditioning container 8 in the middle level 42 provides a free space 76 in the bottom level. Heavy containers can be placed directly on the bottom 58 of the apparatus cabinet without the cabinet having to be strengthened and without these heavy containers having to be lifted into an upper level of the cabinet. Such relatively heavy and relatively large containers may, for instance, be a container 78 for the alcohol and a container 80 for the additive for the preparing and conditioning the process water in the conditioning container 8. These containers 78 and 80 can be storage containers or containers from which the alcohol or the additive are fed by the metering device 60 into the conditioning container 8. Furthermore, the free space 76 in the bottom level 41 may contain fresh-water connecting means 82, feed connecting means 84 and return connecting means 86 for the process water of the conditioning container 8. The fresh water line 62 is connected via the metering device 60 to the fresh-water connecting means 82. An external fresh-water feed line can be connected to the latter. A process water feed line 88 is connected to the feed connecting means 84. It contains a pump 90 for conveying process water from the conditioning container 8 via the feed connecting means 84 to a consuming device, for instance, a printing press (not shown), and from the consuming device or printing press back to the return connecting means 86 to which there is connected a return line 92 through which the process water that was not consumed in the device or printing press flows back into the conditioning container 8. The consuming device or printing press can be detachably connected via two fluid lines to the feed connecting means 84 and the return connecting means 86.

In the preferred field of use, in which the process water is damping solution for a printing press, the damping solution is conveyed by the pump 90 from the apparatus cabinet to a damping-solution container of the printing press and a part of the damping solution is conveyed onto a printing-plate cylinder and/or a blanket cylinder or onto other parts of the printing press. Any excess damping solution flows over an overflow of the damping-solution container back into the apparatus cabinet. If the damping-solution container of the printing press is arranged higher up than the conditioning container 8, then the return flow of the excess damping solution from the damping-solution container via the return connecting means 86 and the return line 92 into the conditioning container 8 can take place due to gravity. If the force of gravity is not sufficient, an additional pump can be inserted in this branch of the line. Such a process water circuit or damping solution circuit having an overflow damping solution container on the printing press is an "open circuit". When the circuit is a "closed circuit", the pump 90 in the feed line 88 can be dimensioned so that its pressure is sufficient also for return over the return line 92.

The consuming device which is connected to the feed connecting means 84 and the return connecting means 86 forms an external process-water circuit.

Filters for the different liquids which are fed to the conditioning container 8 can be present in or on the conditioning container 8. The process water can be damping solution or cooling water for a printing press or some other machine. Examples for damping solution and cooling water for a printing press are known from Federal Republic of Germany Unexamined Application 42 02 544 A1 and from EP 0 602 312 A1. These two documents show the preferred fields of use for an apparatus cabinet in accordance with the invention.

Although the present invention has been described in relation to a particular embodiment thereof, many other variations and modifications and other uses will become apparent to those skilled in the art. It is preferred, therefore, that the present invention be limited not by the specific disclosure herein, but only by the appended claims.

What is claimed is:

1. An apparatus cabinet for providing process water for printing presses, the cabinet including a housing which includes three levels, a bottom level, an intermediate level and a top level; and in the housing:

a water conditioning device including a conditioning container disposed generally at the intermediate level for conditioning process water with respect to the components thereof and the temperature thereof, the conditioning container being arranged in the intermediate level at an operating height between the knee height and the chest height of an average height operator;

a water temperature control device in the housing for controlling the temperature of the process water in the conditioning container, the water temperature control device including a coolant circuit for conveying coolant in the flow direction of the coolant, the coolant circuit comprises a cooling compressor for compressing the coolant, the compressor being disposed in the bottom level of the housing; a cooling condenser in the top level of the housing means for cooling the coolant in the condenser also disposed in the top level of the housing, and the coolant circuit further includes means in the circuit for collecting coolant;

in the housing, a heat exchanger through which the coolant passes, and the heat exchanger communicating with the process water for cooling the process water.

2. The cabinet of claim 1, wherein the means for cooling the coolant in the condenser comprises a blower in the top level of the housing for blowing air on the condenser, and means in the top level of the housing for conducting the air blown over the condenser out of the housing.

3. The cabinet of claim 2, further comprising a cover opening in the top level of the housing for discharge of air which has been blown by the coolant blower device over the coolant condenser and has been heated by the coolant condenser.

4. The cabinet of claim 1, further comprising a coolant expansion valve in the circuit after the condenser in the flow path of the coolant for permitting expansion of the coolant and cooling thereof.

5. The cabinet of claim 4, wherein the coolant expansion valve is located in the bottom level of the housing.

6. The cabinet of claim 1, wherein the means in the circuit for collecting coolant comprises a coolant collector in the bottom level of the housing.

7. The cabinet of claim 1, wherein the heat-exchanger is primarily located in the bottom level of the housing.

8. The cabinet of claim 1, wherein the housing has a space in the bottom level thereof and containers for containing components to be added to the process water in the conditioning container are disposed in the space in the bottom level of the housing and are connected with the conditioning container.

9. The cabinet of claim 1, further comprising an external process water circuit and connecting means from the conditioning container to the external circuit for a flow of coolant from the conditioning container to the external process water circuit and for flow of at least part of the process water back to the conditioning container, the connecting means for the connection of the external process water circuit to the conditioning container being disposed in the bottom level of the housing.

10. The cabinet of claim 1, further comprising a fresh water connecting means leading to a fresh water feed line into the conditioning container for delivering fresh water to the conditioning container, these elements being in the bottom level of the housing.

11. The cabinet of claim 10, wherein the housing has a space in the bottom level thereof and containers for containing components to be added to the process water in the conditioning container are disposed in the space in the bottom level of the housing and are connected with the conditioning container.

12. The cabinet of claim 11, further comprising a metering device for metering addition of components and water to the conditioning container, the metering device being arranged in the intermediate level of the housing.

13. The cabinet of claim 12, further comprising an electronic control device connected with the metering device and supported in the housing generally at the height of the intermediate level for controlling processes for conditioning of the process water.

14. The cabinet of claim 12, wherein the housing has a space in the bottom level thereof and containers for containing components to be added to the process water in the conditioning container are disposed in the space in the bottom level of the housing and are connected with the conditioning container.

15. The cabinet of claim 1, wherein the conditioning container at the intermediate level provides a separation between the bottom and the intermediate levels.

16. The cabinet of claim 15, wherein the housing comprises a first housing over and defining the housing bottom and intermediate levels and a second housing on top of the first housing and defining the housing top level.

17. The cabinet of claim 1, wherein the housing comprises a first housing over and defining the housing bottom and intermediate levels and a second housing placed on top of the first housing and defining the housing top level.

18. The cabinet of claim 17, further comprising a door on the housing extending over the height of both of the first and second housing for simultaneously closing and opening both housings.

19. The cabinet of claim 1, wherein the heat exchanger includes a first heat exchange element in the coolant circuit; and a process water flow circuit for passing the process water therethrough and into the conditioning container, a second heat exchange element in the water flow circuit for being cooled by the first heat exchange element.

20. An apparatus cabinet for providing process water for a printing press comprising a housing having a bottom, an intermediate and a top level;

a process water conditioning device for controlling the temperature of the process water disposed in the intermediate cabinet level;

a water temperature control circuit including a coolant compressor arranged at the bottom level of the housing;

the circuit including a coolant condenser which receives coolant from the compressor, the condenser arranged in the top level of the housing, the circuit further including a heat exchanger for communicating with and cooling the process water;

a blower in the top level of the housing for conveying cooling air over the cooling condenser and out of the apparatus cabinet for cooling the condenser and the coolant therein; and means for delivering the process water from the conditioning device to a printing press which uses the process water.

* * * * *